US006039681A

United States Patent [19]

Heinz-Michael

[11] Patent Number: 6,039,681

[45] Date of Patent: Mar. 21, 2000

[54] HEATING ROLL

[75] Inventor: Zaoralek Heinz-Michael, Königsbronn, Germany

[73] Assignee: Schwabische Huttenwerke GmbH, Aalen-Wasseralfingen, Germany

[21] Appl. No.: 08/720,680

[22] Filed: Oct. 2, 1996

[30] Foreign Application Priority Data

Oct. 13, 1995 [DE] Germany ..... 195 38 236

[51] Int. Cl.[7] ..... B23P 15/00

[52] U.S. Cl. ..... 492/20; 492/46; 34/125

[58] Field of Search ..... 492/46, 20; 165/89; 34/125

[56] References Cited

U.S. PATENT DOCUMENTS 3,721,016 3/1973 Lee et al. .
4,194,299 3/1980 Wiberg et al. .
4,924,603 5/1990 Wolf .
5,662,572 9/1997 Zaoralek .

FOREIGN PATENT DOCUMENTS 38 01 815 A1 8/1989 Germany .
43 13 379 A1 10/1994 Germany .

*Primary Examiner*—Paul T. Sewell
*Assistant Examiner*—J. Mohandesi
*Attorney, Agent, or Firm*—Renner, Otto, Boisselle & Sklar, P.L.L.

[57] ABSTRACT

A steam-heated roll having a longitudinal axis and a roll center, comprising substantially axially extending heating passages for heat supply arid removal, and discharge passages for condensate dewatering extending substantially radially from the heating passages to the roll center. The discharge passages include at least one cross-sectional constriction for effecting a turbulent mixing of condensate mixed with the steam during passage through the discharge passages.

17 Claims, 7 Drawing Sheets

HEATING ROLL

BACKGROUND OF THE INVENTION

1. Field of the Invention

The invention relates to the design of steam-heated, preferably metallic rolls which are put to use e.g. in paper-making machines, film/sheet drawing machines or similar machine equipment. For this purpose the rolls often need to be heated, for which liquid or gaseous heat transfer media find application. In one particular aspect of such rolls a plurality of drilled passages is provided located axially parallel near to the periphery, through which the heat transfer medium is guided. In this respect the invention involves the aspect in which steam is used as the heat transfer medium.

2. Description of the Prior Art

One such roll is described in DE-A-43 13 379 of the applicant. The embodiment of the roll is designed therein to provide for the steam directed through the peripheral drilled passages to condense therein at least in part, upon which the condensate, supported by centrifugal force, flows to the ends of the peripheral drilled passages at each end of the roll where, due to the vapor pressure or a negative pressure applied to a discharge conduit, it is forced through tubes or drilled passages to the axis of the roll from which it may be discharged from the roll through the drain conduit. One such tube or drilled passage is situated at each end of the peripheral drilled passages. In this arrangement the amount of condensate discharged can be controlled by a condensate control valve. Thus the heating performance of the roll can also be determined.

Condensate control valves of this kind have a proven record of success in comparable applications—such as e.g. in the steam heating of plate presses. However, when applied in conjunction with peripheral drilled rolls trouble in operation cannot be totally excluded due to the special features involved in operation. Slight irregularities in the amount of condensate materializing or, as a result of circulation, in dewatering the various discharge tubes or drilled passages may cause steam to be blown through the discharge tubes or drilled passages. This prompts the condensate control valve to shut off in advance. The further dewatering of the roll is restricted, making it impossible in the end.

It has been attempted to accelerate condensation of the blown steam through the discharge conduit, e.g. by means of non-insulated conduits or an additional condenser. This then causes the condensate control valve to reopen and condensate is again able to leave the roll. Experience has shown, however, that in this way too, totally consistent dewatering of all peripheral drilled passages is not always assured and that individual conduits may still remain filled with condensed water during operation. This results in lack of uniformity in heating the roll and thus in its thermal distortion as well as in imbalances in roll running.

Furthermore, attempts have been made to do away with the condensate control valve and, instead, to allow a certain flow of blow-through steam. This has the advantage that non-condensable gases gaining access to the roll and obstructing heat transfer are also swept from the roll. Systems for controlling the amount of steam blown through are known e.g. for drying cylinders in paper-making machines. A distinction is made here between differential pressure control systems and flow amount control systems.

The differential pressure control system comprises in the discharge conduit a throttle valve which maintains a specific differential pressure between the inflow conduit and the outflow conduit of the roll. If more steam than is required attempts to flow through the roll, the pressure differential of the conduits increases and the valve closes, and vice-versa. In flow amount control the amount of overblow steam in the outflow conduit is determined, e.g. at a restrictor, by measuring the pressure loss, and directly controlled via a correspondingly controlled throttle valve.

These two systems also fail to work reliably enough in the case of steam-heated rolls of the type incorporating peripheral drilled passages. Since either the common pressure difference is specified for all dewatering tubes of a peripherally drilled roll or the sum of the blow-through steam through all dewatering tubes is also measured in common, it may happen time and again that flow differences materialize in the individual dewatering tubes which lead, on the one hand, to intensified steam blow-through in individual tubes or a group thereof and, on the other, to flooding of individual or several peripheral drilled passages.

SUMMARY OF THE INVENTION

The object of the invention is to propose a preferably temperature-controllable, steam-heated roll in which removing the condensate resulting in the drilled passages is reliably achieved in every operating condition.

This object is achieved by the discharge tubes or drilled passages being configured so that they cause a mixing, preferably swirling, of condensate and steam.

For this purpose at their ends in the vicinity of the peripheral drilled passages a very small internal diameter e.g. between 2 and 4 mm may be provided. As a result of this a strong increase in the flow velocity of the condensate and of the blow-through steam is achieved so that the resulting tubulence prevents the two media from demixing. The clear opening has a cross-sectional area of preferably 3 to approx. 12 $mm^2$, particularly 3 to 7 $mm^2$, and especially preferred approx. 3 $mm^2$.

In the, preferably full-length, discharge tubes or drilled passages which at the ends of the peripheral drilled passages are intended to discharge the condensate to the center of the roll, mixing of the condensate and the entrained blow-through steam occurs. The condensate no longer remains, forced by the high centrifugal force, at the circumference, whilst the blow-through steam flows quickly to the axis of the roll. In this way the individual peripheral drilled passages are dewatered consistently.

A comparable effect is achieved by employing nozzles at the ends of the discharge tubes or drilled passages facing the roll circumference. These also result in an intensified mixing of condensate and blow-through steam in the further course of the tubes or drilled passages.

Also suitable for generating the mixing required is to render the tubes tortuous.

Preferably, such a discharge tube is configured so that the flow is sharply deflected at least once. For this purpose a fitting or the like may be provided.

Also possible is to dewater two peripheral drilled passages, connected by two connecting tubes or passages to the discharge tube or discharge drilled passage, by one common such tube or by a common such drilled passage.

Furthermore, it is possible to incorporate additional baffles at one or more points in the tubes or drilled passages.

Each of the aspects according to the invention as defined above enables an operating point to be found individually for each roll at which the condensate occuring in the peripheral drilled passages is reliably removed from the individual drilled passages according to the given operating speed, the given heating steam pressure and the set outer differential pressure for the roll as a whole without the various drilled passages influencing each other excessively and without the amount of steam to be blown through in total being so high that it would be uneconomical. In this respect it has been found advantageous not to exceed a maximum of ten percent by weight of condensed steam. More than 20 percent by weight is outside of good operating practice. When the "dewatering capacity" and the "condensate occurence" or the "steam thruput" per hour for such an operating point of an individual dewatering tube or a single dewatering drilled passage at the end of a peripheral drilled passage is plotted on the y axis and the percentage of blow-through steam or overblow steam on the x axis, then in the case of the configuration of the rolls in accordance with the invention two curves materialize which intersect in the range between in excess of 5% and at less than 20% overblow steam portion.

Experience has additionally shown that configuring the discharge tube or drilled passage in accordance with the invention automatically results in adjustment of the equilibrium between the condensate level in the peripheral drilled passage and overblow steam passing through. If the portion of overblow steam increases for any reason, the dewatering capacity of the tube decreases. The condensate level in the peripheral drilled passage increases and throttles the portion of overblow steam. Conversely, in the case of an excessive condensate discharge in a peripheral drilled passage the condensate level drops and the opening of the dewatering tube is exposed for an intensified thruflow of overblow steam.

In the case of high vapor pressures and smallish roll dimensions conditions may arise in which equilibrium is attained not before the portions of overblow steam are undesirably high. However, limiting the portion of overblow steam outside of the roll, e.g. by steam amount control, is not expedient, because then the conditions of inconsistent dewatering of the peripheral tubes, as described at the outset, arise. In such a case it may prove expedient, as compared to this, to group two or even more peripheral drilled passages together and to provide only a single discharge tube or a discharge drilled passage at each side. The doubled or multiplied thruput then again results in the intended mixing of condensate and blow-through steam. In this arrangement groups having possibly few peripheral drilled passages are to be formed to prevent a merging flow of condensate in the lower region of the roll, should the roll be halted.

It is also true, however, that the necessary restrictions in the cross-sections of the discharge tubes or drilled passages also represent a risk to proper operation of the valves or fittings in the tubes or drilled passages since choking may occur. Foreign objects or also corrosion products entrained by the steam are able to gain access to the inlet openings of the dewatering tubes or the points of restriction all the more easier, the less the free diameters are in each case. This is why in a preferred embodiment, at the side of the discharge tubes or drilled passages facing the outer periphery, a cage or an interceptor is arranged, the openings or mesh of which correspond, at the most, to the diameter of tightest cross-sections of the discharge tubes or drilled passages. Any foreign object capable of choking these tightest cross-sections is held back at the cage. Since the cage or interceptor has many such openings, it would take many such foreign objects to cause choking. A further safety measure materializes from the fact that each peripheral drilled passage comprises two such tubes or drilled passages, namely at both ends. Should it nevertheless be impossible to exclude such foreign objects occuring over lengthy operating periods, it is good practice to configure the closures as required by design according to the aforementioned DE-A-43 13 379 as service openings which can be opened and reclosed by simple means. Through such service openings the cages or interceptors can then be serviced without any major interference at the roll, e.g. disassembling the roll journals being necessary.

It is also then possible with certain roll configurations to exchange discharge tubes when these should incur cavitation damage due to the high condensate rates over a long time of operation.

BRIEF DESCRIPTION OF THE DRAWINGS

One aspect in accordance with the invention of a peripheral drilled roll will now be described with reference to the FIGS. 1 to 7, in which.

DESCRIPTION OF THE PREFERRED EMBODIMENTS

Figure 1:
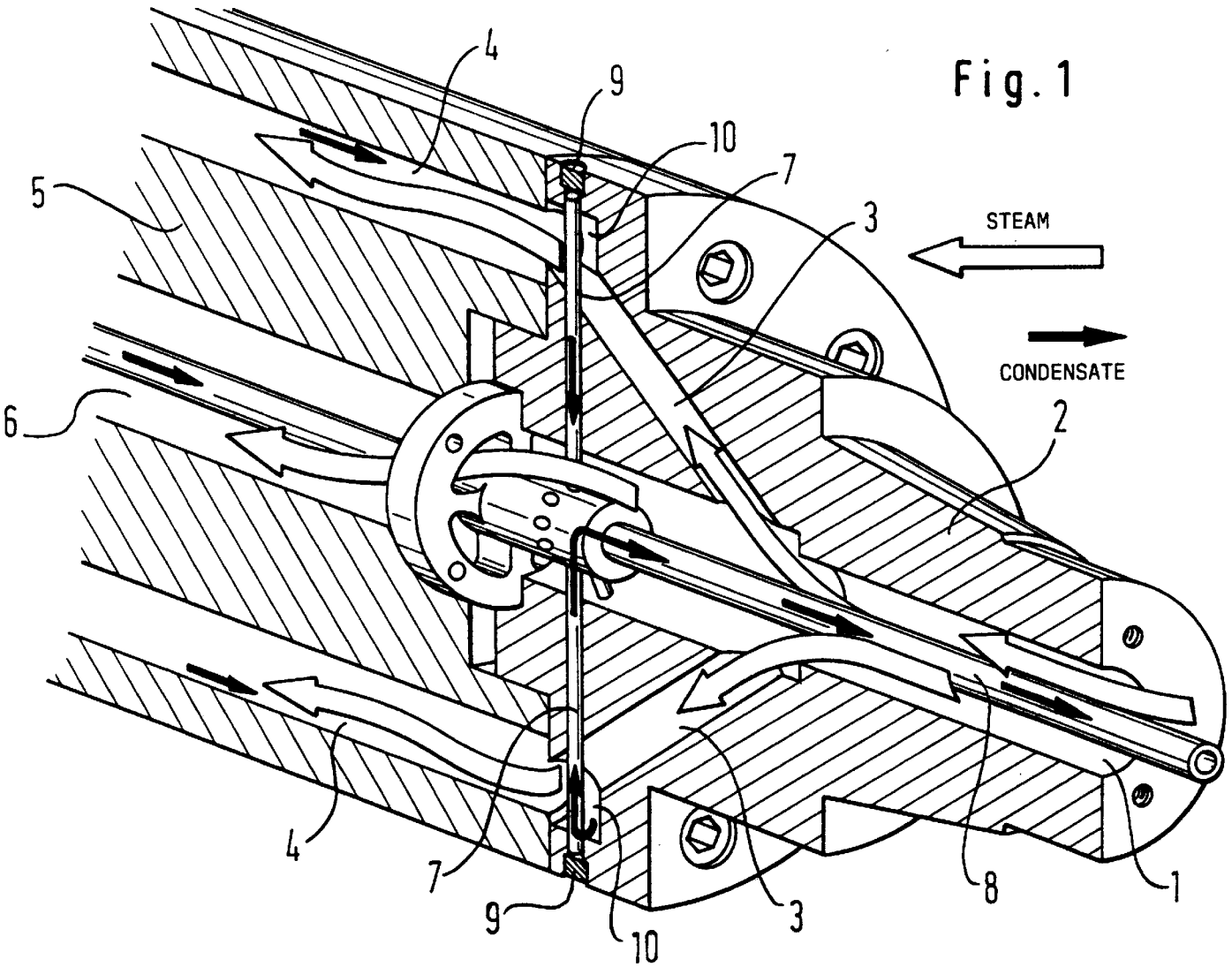
FIG. 1 shows part of a roll, the journal region on one side in a perspective section view.

As evident in FIG. 1 hot steam (white arrows) flows through the supply tube 1 into the roll journal 2 , further—on the one hand—through the steam passages 3 into the peripheral drilled passages 4 in the body of the roll 5 and—on the other through the central bore 6 in the roll body 5 to the other end of the roll to be again directed into the peripheral drilled passages through steam passages. Condensate forming in the peripheral drilled passages (black arrows) is forced out of the drilled passages 4 by means of vapor pressure and flows to the end of the roll, either forwards, i.e. in the direction of the steam flow, or rearwards, against the latter direction, as illustrated in the drawing. The condensate collects in the receiving spaces 10 from which it gains access, still under vapor pressure, through the discharge tubes 7 to the return tube 8 through which it is able to leave the roll. The discharge tubes are provided at their outer end with a plug 9.

Figure 2:
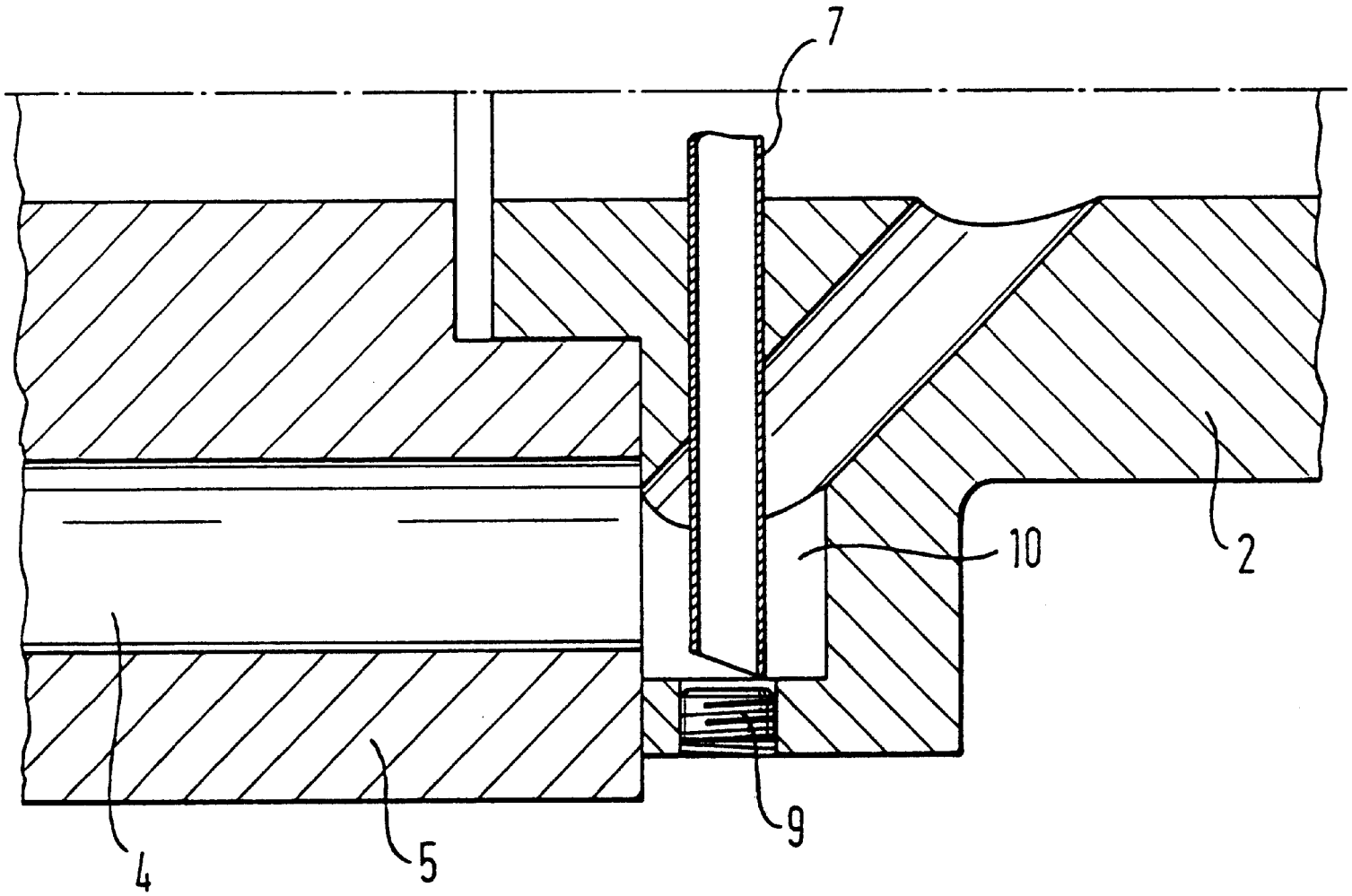
FIG. 2 shows as a sectional view of FIG. 1 a discharge tube according to existing prior art.

FIG. 2 shows, as a section view of FIG. 1, a discharge tube 7 in accordance with prior art.

Figure 3:
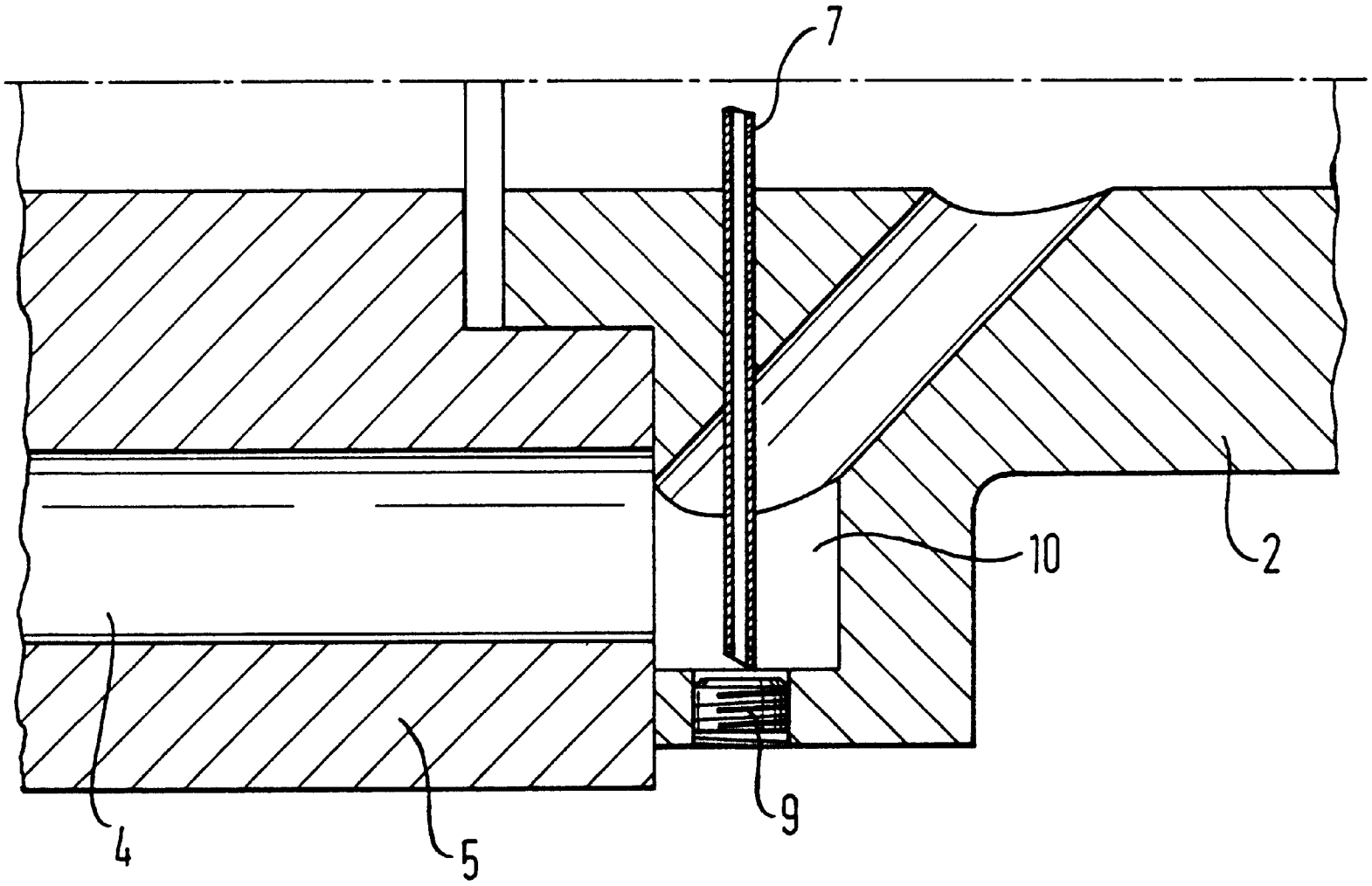
FIG. 3 shows an aspect according to the invention of a discharge tube having an internal dimension of approx. 2–4 mm.

FIG. 3 shows an aspect in accordance with the invention of discharge tube 7, the cross-sections of the tube 7 being constricted.

Figure 4:
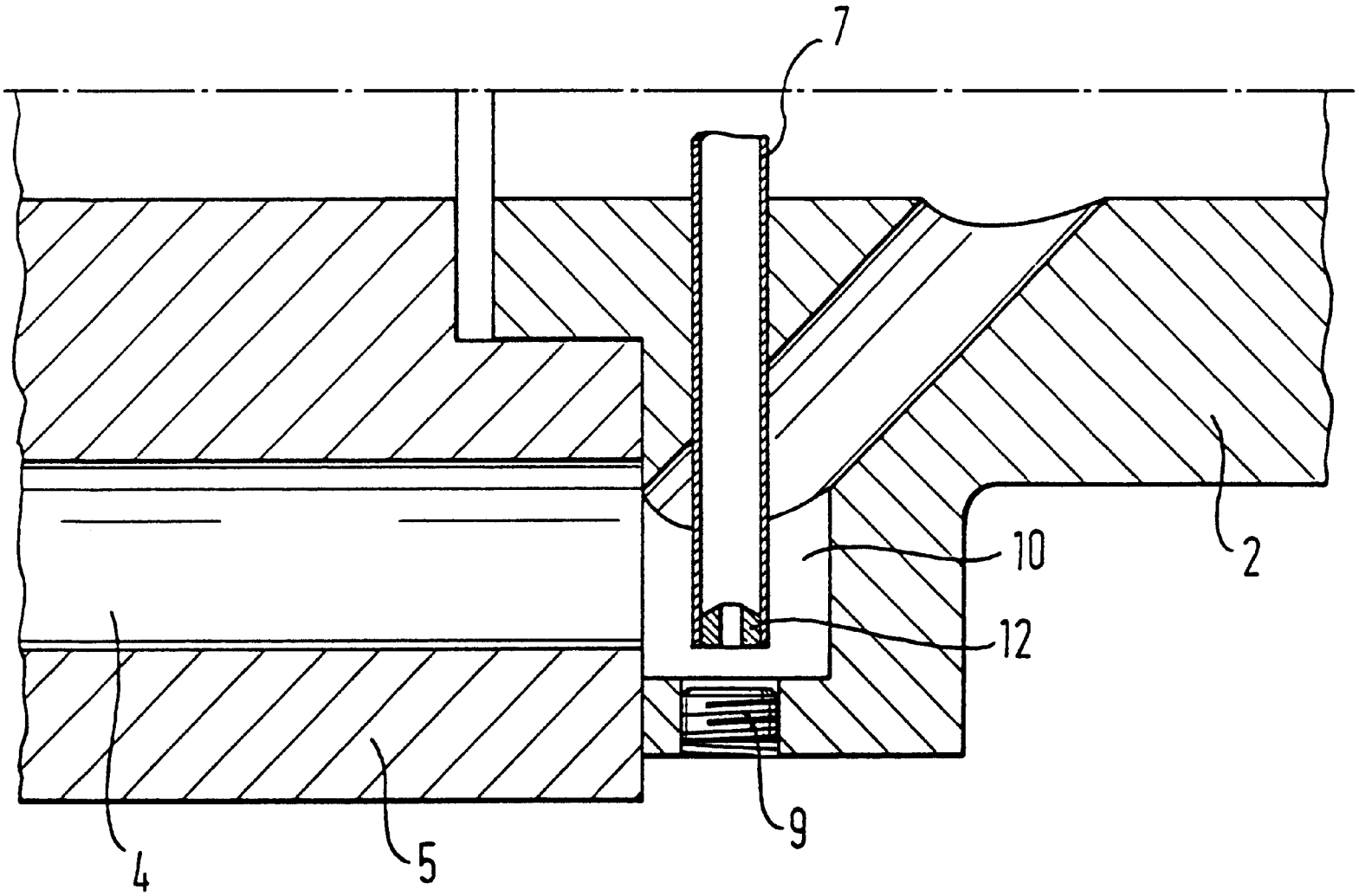
FIG. 4 shows an aspect according to the invention of a discharge tube having a nozzle for swirling the condensate with the overblow steam.
Figure 5:
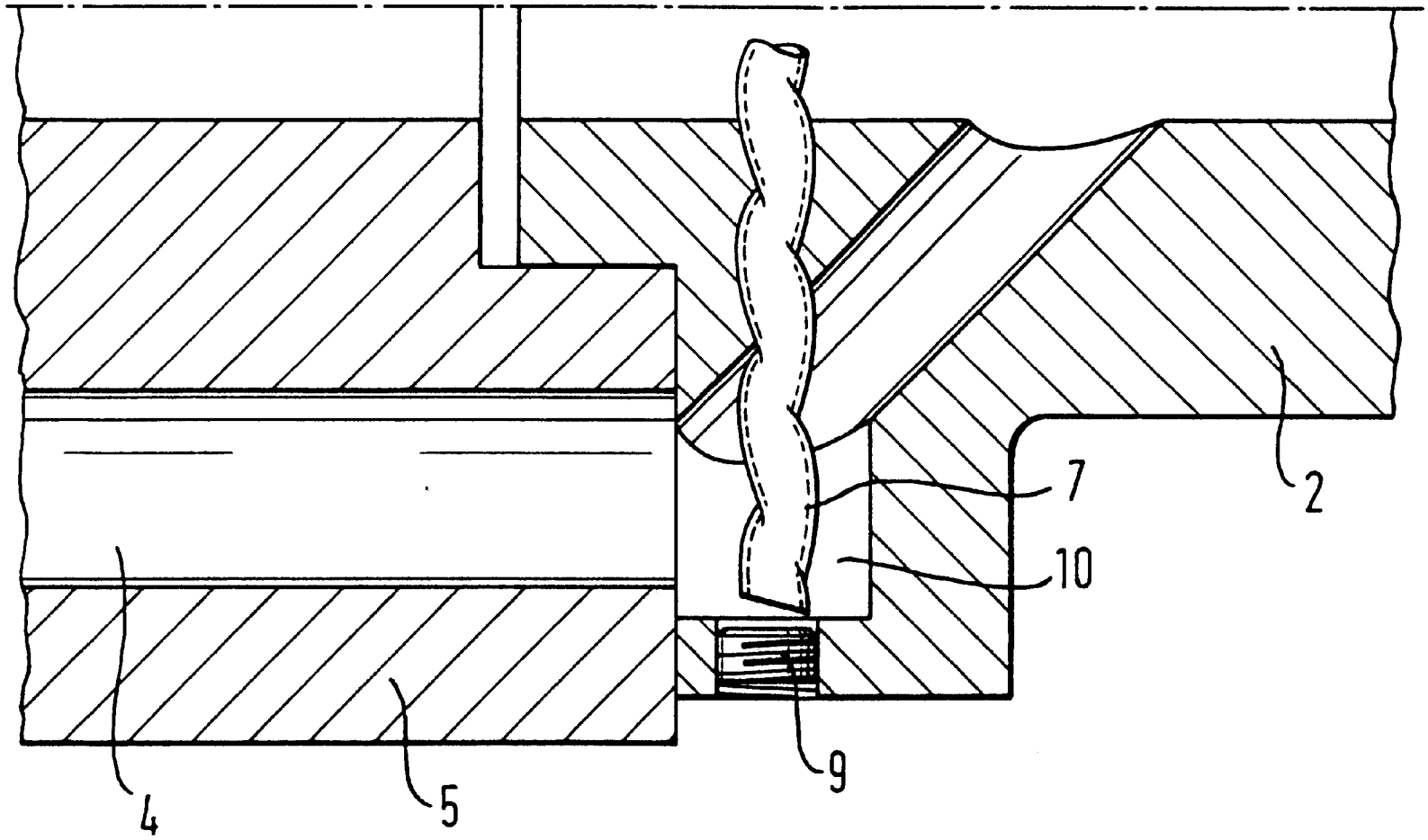
FIG. 5 shows a possible aspect in which the swirling is achieved by a tortuous arrangement of the discharge tube.

In FIG. 4 a tube is shown with a nozzle 12 inserted instead of the tube constriction. FIG. 5 shows a discharge tube 7 in a tortuous arrangement. As a result of this swirling of condensate and blow-through steam is achieved so that consistent dewatering can take place.

Figure 6:
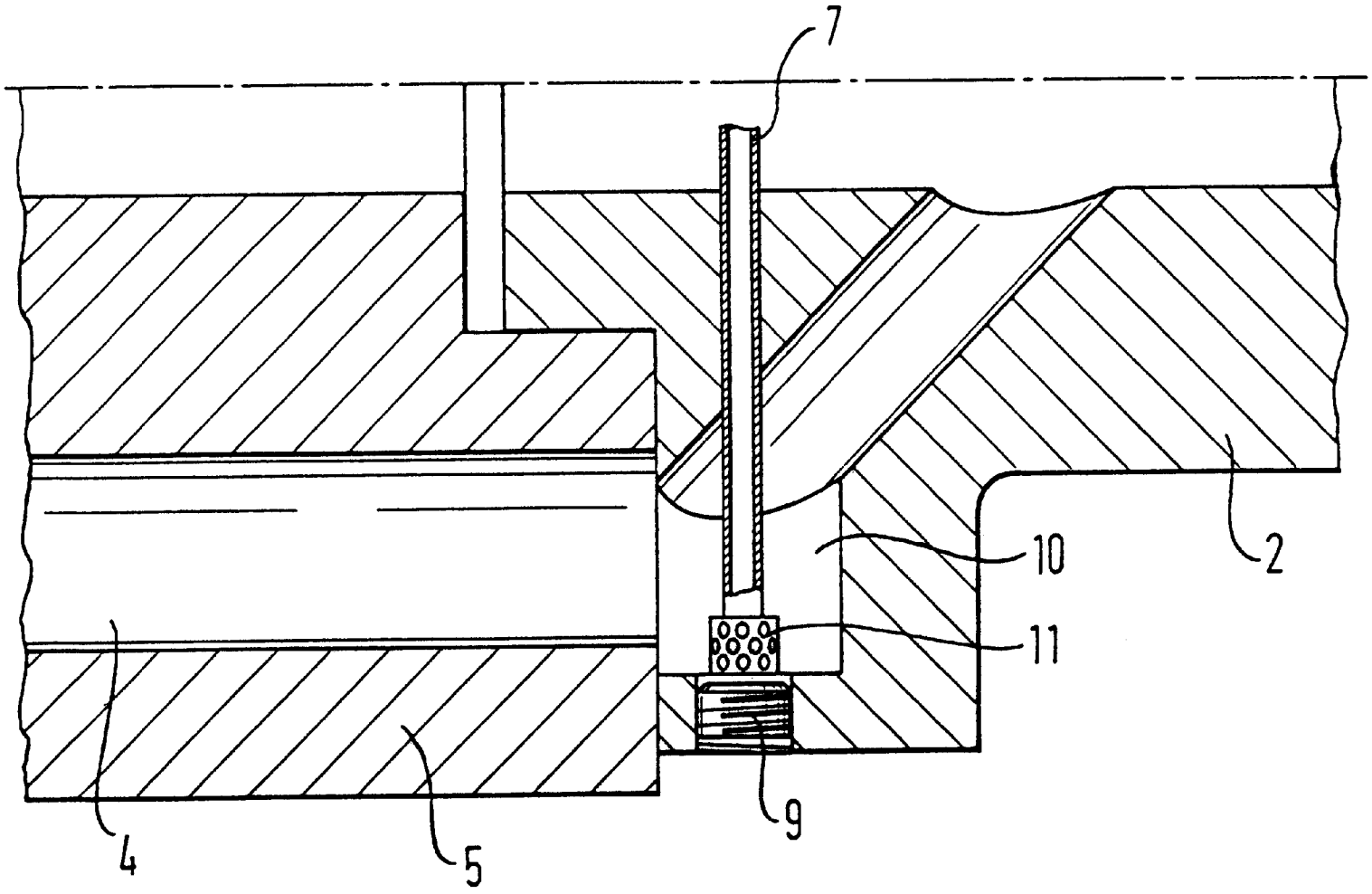
FIG. 6 shows a discharge tube configured in accordance with the invention with a strainer.

In FIG. 6 the arrangement of a strainer 11 upstream of the discharge tube 7 is illustrated. To permit cleaning when a strainer 11 is employed the opening for the plug 9 is configured so large that the strainer 11 can be inserted and removed.

Figure 7:
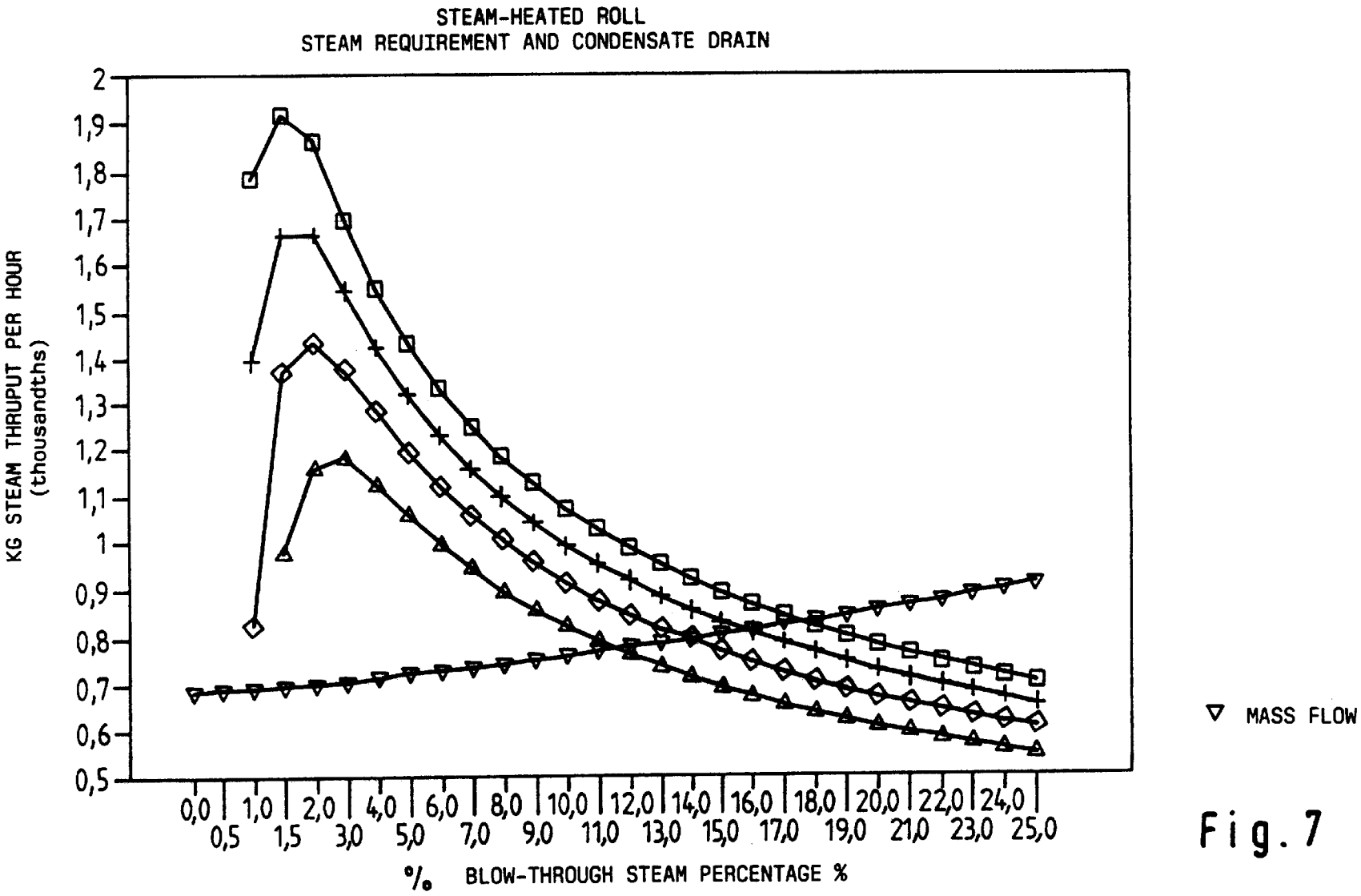
FIG. 7 is a graph plotting the steam requirement and the condensate drain of a roll in accordance with the invention.

In conclusion, FIG. 7 illustrates by way of an example the dependencies between the steam requirement of the roll and the blow-through steam. The four curves falling off to the right therein represent the dewatering capacities of the rolls at various differential vapor pressures (from top to bottom: 0.8/0.7/0.6/0.5 bar); whereas the bottom curve rising slightly to the right corresponds to the steam thruput, with an increasing portion of blow-through steam in percents by weight in each case. The intersections of the curves are the stable operating points for the set differential pressure and given heating capacity. As is evident, these lie in the range of 5 to 20% blow-through steam.

I claim:

1. A steam-heated roll having a longitudinal axis and a roll center, comprising substantially axially extending heating passages for heat supply and removal, and discharge passages for condensate dewatering extending substantially radially from the heating passages to the roll center, wherein said discharge passages include means for effecting a turbulent mixing of condensate and steam for maintaining the condensate mixed with the steam during passage through the discharge passages, said means for effecting including at least one cross-sectional constriction in said discharge passages.

2. The steam-heated roll as set forth in claim 1, wherein said heating passages are disposed in a peripheral region of the roll.

3. The steam-heated roll as set forth in claim 1, wherein said at least one cross-sectional restriction is formed by a nozzle or restriction aperture inserted in at least one of the discharge passages.

4. The steam-heated roll as set forth in claim 1, wherein at least one of said discharge passages is tortuous for deflecting the flow during passage through said at least one discharge passage.

5. The steam-heated roll as set forth in claim 4, wherein said at least one discharge passage is formed by at least one fitting for sharply deflecting the flow within said at least one discharge passage.

6. The steam-heated roll as set forth in claim 1, wherein said discharge passages comprise at said at least one cross-sectional constriction a free opening of between 3 and about 12 $mm^2$.

7. The steam-heated roll as set forth in claim 6, wherein said free opening at said at least one cross-sectional constriction is between 3 and 7 $mm^2$.

8. The steam-heated roll as set forth in claim 1, wherein at least two of the heating passages are connected by means of one or more connecting tubes or passageways to a discharge passage and are dewatered thereby.

9. The steam-heated roll as set forth in claim 1, wherein maximally a quarter of said heating passages are connected by means of one or more connecting tubes or passageways to a discharge passage and are dewatered thereby.

10. The steam-heated roll as set forth in claim 1, wherein in the direction of flow upstream of said discharge passages a strainer or sieve is arranged, the openings of which are smaller than or equal to the smallest diameter in said discharge passage.

11. The steam-heated roll as set forth in claim 1, wherein, radially opposite the outer ends of said discharge passages, openings are provided in the roll and are closed off by removable closure means.

12. The steam-heated roll as set forth in claim 11, wherein said openings are sized to permit said strainer to be removed therethrough.

13. A method of controlling the steam flow through and the condensate discharge from a steam-heated roll, comprising the steps of:

providing a steam-heated roll including substantially axially extending heating passages for heat supply and removal, and discharge passages for condensate dewatering extending substantially radially from the heating passages to a roll center, wherein the discharge passages include at least one cross-sectional constriction for effecting a turbulent mixing of condensate and steam for maintaining the condensate mixed with the steam during passage through the discharge passages, communicating steam from an inlet to the heating passages, communicating mixed condensate and steam from the discharge passages to an outlet, and controlling a pressure difference between said inlet and said outlet depending on a desired heating capacity, vapor pressure and rotary speed of the roll so that the percentage of overblow steam to total steam and condensate at the outlet is less than 20 percent by weight.

14. A method of controlling the steam flow through and the condensate discharge from a steam-heated roll as set forth in claim 13, wherein the percentage of overblow steam at the outlet is between 5 and 15 percent by weight.

15. The steam-heated roll as set forth in claim 1, wherein at least one of said discharge passages is formed by one or more discharge tubes disposed in said roll.

16. The steam-heated roll as set forth in claim 15, wherein, radially opposite the outer ends of said discharge tubes, openings are provided in the roll and are closed off by removable closure means.

17. The steam-heated roll as set forth in claim 16, wherein said openings are sized to permit the complete discharge tube to be removed therethrough.

* * * * *